United States Patent [19]

Ku et al.

[11] 4,240,756

[45] Dec. 23, 1980

[54] OPTIMIZED WIRE MATRIX IMPACT PRINT HEAD

[76] Inventors: Joseph P. Ku, 1083 Grebe St., Foster City, Calif. 94404; Richard D. Trezise, 1204 Thornmill Way, San Jose, Calif. 95121

[21] Appl. No.: 928,200

[22] Filed: Jul. 26, 1978

[51] Int. Cl.[2] ..... B41J 3/12

[52] U.S. Cl. ..... 400/124; 101/93.05

[58] Field of Search ..... 101/93.05; 400/124

[56] References Cited

U.S. PATENT DOCUMENTS

| | | | |
|---|---|---|---|
| 3,828,908 | 8/1974 | Schneider | 400/124 |
| 3,929,214 | 12/1975 | Hebert | 400/124 4n |
| 3,994,381 | 11/1976 | Herbert | 400/124 |
| 4,051,941 | 10/1977 | Hebert | 400/124 |
| 4,117,435 | 9/1978 | Hishida et al. | 400/124 X |

FOREIGN PATENT DOCUMENTS

| | | | |
|---|---|---|---|
| 2119641 | 11/1972 | Fed. Rep. of Germany | 400/124 |
| 2707189 | 1/1978 | Fed. Rep. of Germany | 400/124 |

*Primary Examiner*—Paul T. Sewell

*Attorney, Agent, or Firm*—Limbach, Limbach & Sutton

[57] ABSTRACT

An improved wire matrix impact print head comprising a plurality of variable length impact print wires or styli, each having an input end for receiving a propelling force and an output end for delivering an impact to a recording medium. The wire styli are extended from the input end to the output end through a stylus guide assembly where the styli are arranged at the input end of the guide assembly in an irregular oval-like configuration, to favor certain frequently used styli with less bow or bend of their paths, and the styli are arranged at the output end in a continuous linear array configuration. At the input end of the guide means the styli are supported by a bearing assembly which comprises two support plates connected to each other, each plate having a plurality of guide apertures about its outer periphery for receiving the styli. Two-pole electromagnetic actuators for selectively propelling the styli during print cycles are provided for each styli by wrapping a wire coil about one of the actuator poles. The poles of the actuator are all located in the same plane so that the air gaps between the stylus propelling means and the coil-wrapped poles are substantially uniform, thereby eliminating the need to adjust any air gaps for obtaining the desired propulsion force on the styli.

17 Claims, 7 Drawing Figures

OPTIMIZED WIRE MATRIX IMPACT PRINT HEAD

BACKGROUND OF THE INVENTION

The present invention relates generally to a high speed printer primarily for use on mini computer units, and more particularly it relates to the matrix-type impact printer utilizing a plurality of print wires which are selectively propelled at their input ends to cause their other end to impact a recording medium and to print a dot thereon. A series of these dots printed by the wires forms a character.

In the matrix printer art, it is desirable to have the input ends of the styli or print wires to be configured as close together as possible just as they are configured in a continuous linear array at the output impact end. This will minimize the deflection of the wire paths from their input to their output ends. However, for various reasons to be explained below, it has been found that a non-spreading linear pattern configuration at the input end of the print wires is difficult to achieve due to the physical size limitation of the various components. To have the print wires configured in a minimal spreading pattern at their input ends would produce a desirable substantially straight wire path and hence result in less friction and wear being applied to the wires at the support points than would be the case where the input ends of the wires are configured in a spreading pattern which results in severely curved wire paths. The magnitude of the frictional force and wear at the wire supports is in direct proportion to the degree of severity of the wire path curvature.

One reason for the difficulty to have the print wires to be configured in a extremely close pattern at their input end is because of the need for the physical size of the tips of wires at the input end where the wires are contacted by a stylus-propeller to cause the necessary impact by the wire on the recording medium. That is, the input end of the print wire needs to have a head of some dimension to allow for the necessary contact between the stylus or print wire and the stylus propeller which needs also to have some dimension in order to make the necessary contact with the head of the print wires. Therefore, the input head of the print wire and also the tip of the means which propells the print wire must be of some dimension at the input end of the wire. This is necessary since if the stylus head was but a point which was of no greater dimension than the remaining body of the stylus or print wire and if the stylus propeller was of no greater dimension than the remaining body of the stylus, contact between the two small points would be very difficult to maintain without physically bonding the two together, which may then create manufacturing cost and other disadvantages such as degraded performance.

Another reason why a spreading configuration of the styli at the input ends is necessary, is because of the physical size and location of the coil of wire which is wrapped around one of the magnetic poles of the electromagnetic actuators which powers the stylus-propeller to propell the styli to impact the recording medium. It is common knowledge that the larger the number of turns in the coil of wire which is wrapped about the magnetic pole, the stronger the force which is produced by the pole. Therefore, where a large number of turns of wire is wrapped around the pole at the input end of the styli, a greater space is needed to situate the poles than where a smaller number of turns of wire is used. However, there is also a need to minimize the length of the stylus propeller in order for them to be as light as possible. Therefore, the contradictory requirements of a large coil v. a short stylus propeller necessitates some degree of spreading of the styli at the input end.

It therefore follows that an objective in the matrix print head art is to maintain the input end of the styli or print wires in a minimal spreading configuration given the coil size and stylus propeller length constraints, in order to minimize the friction applied to the wires at the supports and, as such, to minimize the wear on the wires. Several prior art apparatuses have attempted to accomplish this end. For example, in U.S. Pat. No. 3,994,381, a print head is disclosed which has the input end of the print wires configured in an elliptical configuration. Such a configuration has the effect of bending all print wires at their input end by the same amount. That is, while the print wires of the U.S. Pat. No. 3,994,381 are not configured in a continuous linear array at their input end, resulting in no bend in the wires at this end and, as such, minimal friction applied to the wires, all wires are bent by the same amount, with all bends being equally shallow or equally deep. In such a configuration, none of the print wires are favored, with less bend, any more than any of the others. That is, all wires are favored or none are favored. In the U.S. Pat. No. 3,994,381, where one print wire may be used during printing more than any of the other print wires to make characters, it follows that this most frequently used wire will get more wear and, as such, would likewise have a shorter life span than the other wires, because it is bent just as much at the input end as the wires which are less frequently used.

U.S. Pat. No. 3,929,214 teaches a print head which has the input end of the styli configured in a circle. In such a configuration, some of the print wires at their input ends are bent more than other wires in the configuration in order to be propelled by a stylus propelling means. While some of the wires in the circular configuration are bent more than other wires in a circle, some of these wires would also be bent more than some of the wires in the elliptical configuration of the U.S. Pat. No. 3,994,381 given similar physical size constraints. Also, some wires in the circular configuration are bent less at their input end than other wires in the circular configuration and would also be bent less than some of the wires in the elliptical configuration of the U.S. Pat. No. 3,994,381 given similar physical size constraints. It follows that in the configuration of the U.S. Pat. No. 3,929,214 some wires are favored with less bend, but it is not necessarily the wires which are most frequently used during the printing of characters. That is, there is no advantageous relationship between the wires which are bent the least in the circular configuration and the frequency of use of such wires.

Because of the above discussed problems still remaining in the prior art where the input end of the printing wires are configured in other than a continuous linear array, it follows that it is desirable to have the input ends of these print styli configured at their input end such that those print wires which are most frequently propelled to form characters on a recording medium have the least curvature of their paths so as to result in less wear on these frequently used wires and, as such, to allow for a longer life span for these wires.

Another problem which several prior art print heads have been confronted with is that of adjusting or controlling the air gaps between the stylus-propelling means and the magnetic pole or actuators in order to obtain the desired propelling force on the styli. That is, where a propeller armature, attracted by a magnetic pole, is used to propell the styli, the area between the armature tip which contacts the styli head and the attracting pole which attracts the armature toward it must be controlled or maintained within a range such that the pole will attract the armature tip with a force sufficient to propell the styli through the stylus guide assembly to impact the recording medium. It is desirable that all air gaps for all actuator-stylus propeller combinations in the same print head, as well as all combinations for all print heads manufactured with the same design, be substantially uniform.

Several prior art print heads have incorporated means for adjusting or attempting to control the air gaps in the above combinations, but all efforts so far have met with certain undesirable results. For example, the U.S. Pat. No. 3,994,381, which made use of nine print styli, nine different stylus propelling means and nine different actuators, have also incorporated nine separate and distinct adjustment means to adjust or control the air gaps between the various stylus-propellers and their respective actuators. While such separate means of adjusting the individual air gaps may prove to be quite accurate or efficient, it is undesirable because it is time-consuming and results in greater expense to manufacture.

The '241 patent has sought to deal with the problem of adjusting the air gaps by incorporating one central adjuster for all nine of its stylus propeller-actuator units. Such a central adjusting system obviously has the undesirable result of not being very effective, especially for non-circular pole patterns, where stresses can and usually are introduced into the system and result in the uneven settings of air gaps of the stylus propeller-actuator combinations.

It therefore follows that there is a need in the matrix print head art for a print head apparatus which either has a more efficient and economical means of adjusting the stylus propeller-actuator combination or an apparatus which eliminates the need for adjusting the combinations altogether.

An additional problem which is still present in the prior art print heads is that of adequately and economically supporting the print wires in a bearing assembly at their input ends where they are configured in a spreading pattern configuration. That is, where the print wires are configured at their input ends in a spreading pattern, they must be supported in an angular or slanted position near their input ends and be straightened out near their output or impact ends to form a continuous linear array at their impact ends. In most of the matrix impact printers of the type herein described, a stylus guide means has been incorporated with an initial sytlus bearing support member at the input end of the styli which has been provided with as many apertures, configured about its periphery, as there are styli. The apertures, in order to provide full wear support, need to be formed through the bearing in a slanted direction to support the styli at its input end at an angle relative to the bearing member. In the prior art print heads where there have been seven or nine different styli used to provide long wear, it would have been necessary to form seven or nine apertures in seven or nine different angular directions in the bearing support member. This would result in great expense and hence are not done, thereby penalizing the wear characteristics.

It therefore follows that it is desirable to have an improved bearing support member suitable for supporting the styli in the necessary slanted position at their input ends where all apertures in the support member may be formed at the same angles. That is, it would be highly desirable to have a bearing support member with apertures which simulate a long single slanted aperture, but which is far more economical to manufacture than a bearing where a single slanted aperture must be formed through a rather thick support bearing.

SUMMARY OF THE INVENTION

In view of the above discussed problems which still exist in the matrix impact print head art, it is apparent that there is a need for an improved matrix impact print head which is durable, efficient to operate and economical to manufacture and which solves many of the still existing problems of prior art print heads. Accordingly, we have invented a matrix impact print head which has the styli print wires configured at their input or propulsion end such that those wires which are most frequently used during the print cycles are favored in that they are bent or bowed less than other less frequently used print wires at their input end to minimize the wear on the frequently used wires.

We have further solved the problem of having to adjust the air gaps between the stylus-propelling means and their respective actuators by not varying or adjusting the air gap area either individually or altogether as have been done in the prior art, but rather, we have found a way to control the air gap area and, as such, to eliminate any necessity of adjusting these areas at all. We have accomplished this result by providing a stylus-propellor backstop area in the print head cap plate and by further locating all poles of the respective actuators in the same plane on the print head base plate such that when the cap plate is attached to the base plate, the backstop area will be substantially parallel to the actuator poles, resulting in the air gaps between the stylus-propellers and the actuators being substantially uniform for all propeller-actuator combinations. The backstop area has the effect of keeping all styli-propellers the same distance away from their respective poles when the propellers are in the rest position against the backstop area.

As for the still existing problem of having to form seven or nine apertures (depending upon the number of styli used) in seven or nine different directions in a support bearing member, we have provided a bearing support member at the input or propulsion end of the guide means where such bearing is in two separate parts with apertures of two different configurations formed in each piece. These apertures are easily formable by mass production means such as injection molding. For example, the apertures in one piece of the support member are cone shaped, while those in the other support piece are straight apertures, thereby allowing the styli to be extended through both pieces of the support bearing when they are connected one to the other at an angle while obtaining significantly similar bearing support as a single slanted aperture would provide.

It will be appreciated from the following detailed description that the invention disclosed herein provides a far more durable and efficient matrix impact print head which in the normal course of its life span will print more than four hundred million characters.

BRIEF DESCRIPTION OF THE DRAWINGS

The advantages and characteristics of the subject invention will be in part apparent from the accompanying drawings, and in part pointed out in the following detailed description of the invention in which reference will be made to the accompanying drawings wherein like reference numerals designate corresponding parts, and wherein.

DESCRIPTION OF THE PREFERRED EMBODIMENT

Figure 1:
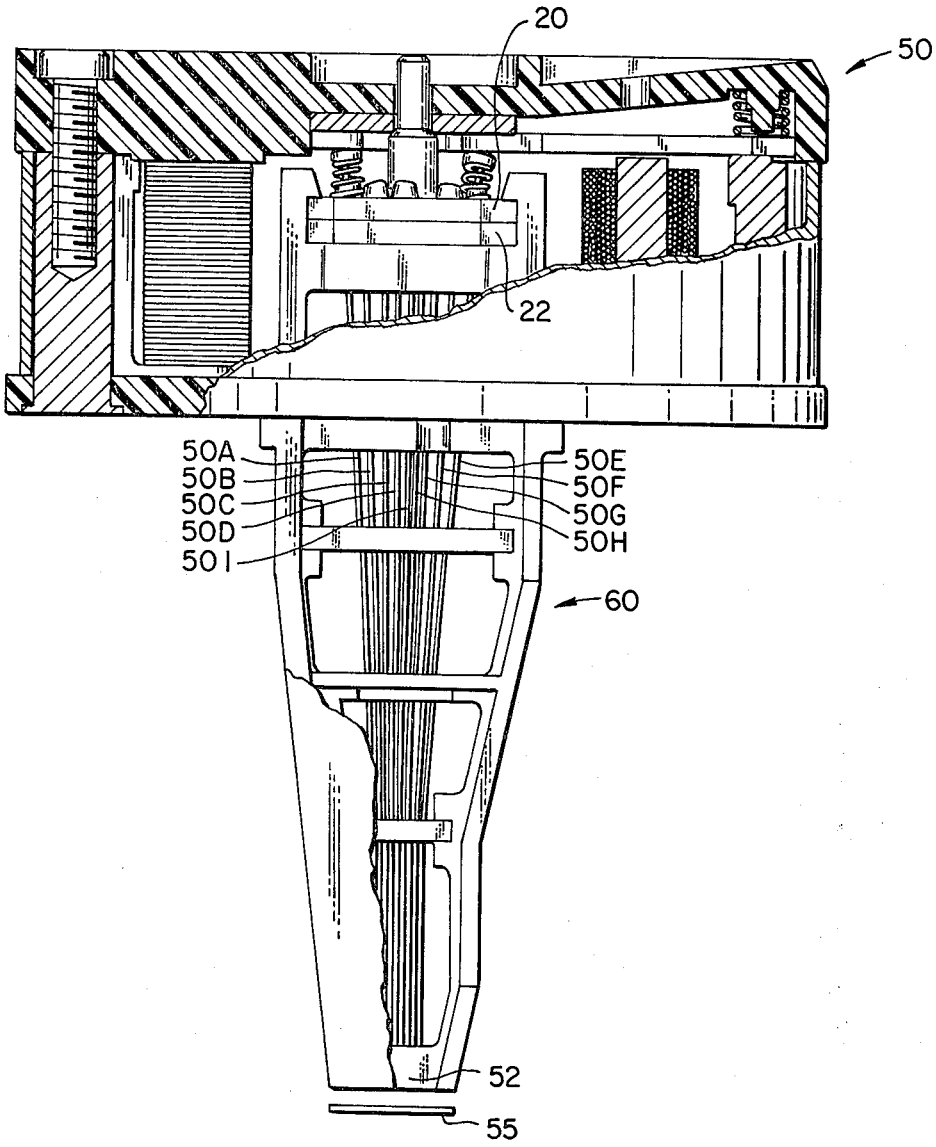
FIG. 1 illustrates an enclosed matrix print head with cut-away portions to illustrate various components which is constructed in accordance with the invention.

Now referring specifically to the individual drawings, FIG. 1 illustrates an enclosed matrix print head 50 which has been constructed in accordance with the invention to be described below. Print head 50 has a cut-away portion illustrating the extended path of a series of styli print wires 50A–50I which terminate at the small end of the print head near the recording medium 55 in a continuous linear array configuration illustrated by reference numeral 52. Print head 50 is shown at its print end 52 to be proximately located near the recording medium 55 on which a dot is printed by one or more of the styli 50A–50I upon certain stylus wire being propelled at its input end (see description below).

Figure 2:
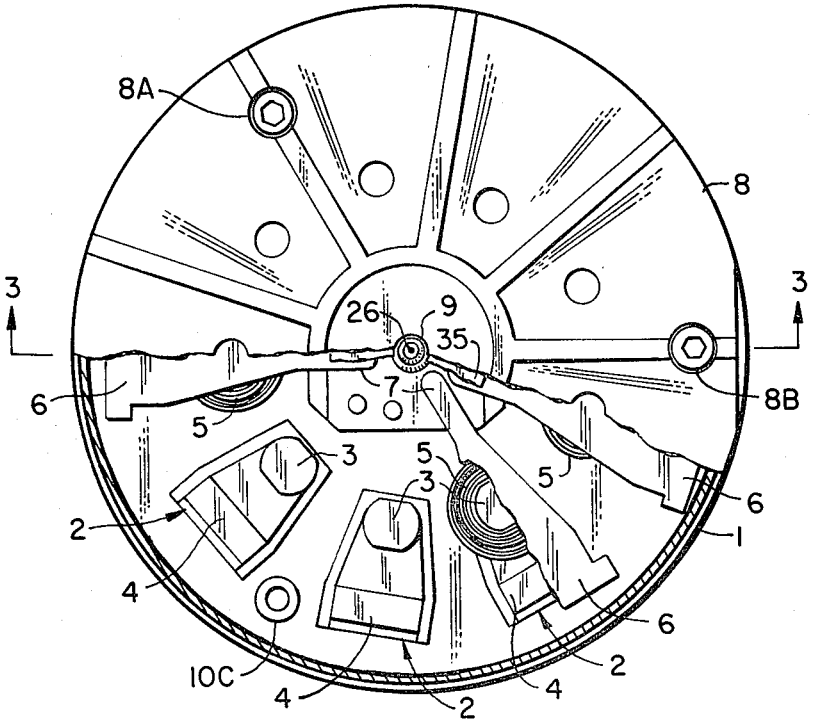
FIG. 2 is a top plan view of the cap plate enclosing the electromagnetic actuator with a cut-away portion showing certain components.

FIG. 2 illustrates a metal base plate 1 with a series of two-pole electromagnetic structures 2 distributed about the surface of plate 1, each electromagnetic structure 2 having a center magnetic pole 3 and an outer pole 4. Pole 3 has a coil 5 (see FIG. 3) wrapped about its elongated surface to form an electromagnet. Plate 1 further has three hollow alignment posts 10A–10C distributed at equidistance about its periphery. A series of electromagnetic armatures or clappers 6 are distributed about the area stop each of the electromagnets 2 (armatures 6 have been omitted above some electromagnets to illustrate the electromagnetic structures) with an extended arm portion 7 of each armature 6 extended beyond the area immediately above pole 3 of structure 2 to contact a stylus head (See FIG. 3 description). A cap plate 8 is partially shown affixed above the series of electromagnets and armatures 6 to enclose the top portion of the print head. Cap 8 has apertures 8A, 8B and 8C (not shown but is located at an equidistance around the periphery of cap 8 as are apertures 8A and 8B) distributed about its outer periphery to receive screws for affixing cap plate 8 to base plate 1. Cap 8 further has a central aperture 9 for receiving an alignment post 26 (see FIG. 4 description) when cap 8 is affixed to base plate 1 and an armature backstop area 35 for contact by armature tips 7 when they are at rest.

Figure 3:
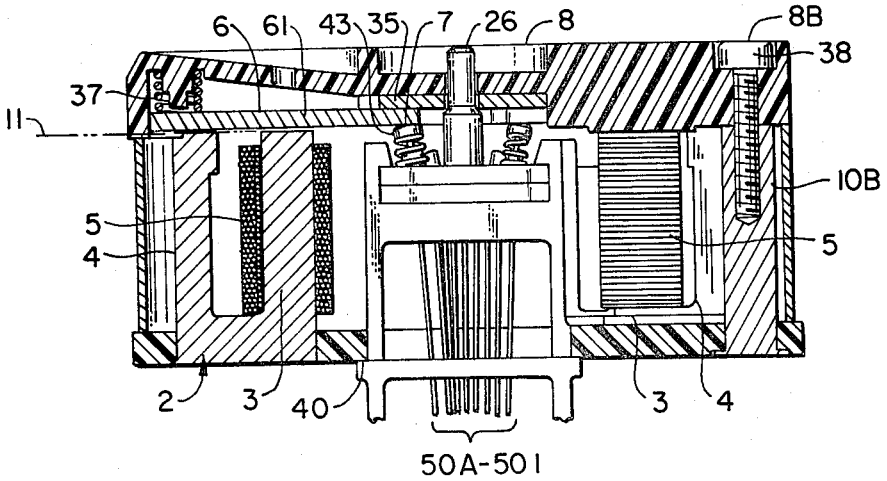
FIG. 3 is a cut-away view of the print head taken along lines 2—2 of FIG. 2.

FIG. 3 illustrates electromagnetic structure 2, each with center poles 3 having coils 5 wrapped about its elongated surface to form an electromagnet and an outer pole 4 all lying in the same plane, as illustrated by dotted line 11. Alignment posts 10A (not shown), 10B and 10C (shown) also lie in the same plane, illustrated by line 11, as poles 3 and 4 of electromagnetic structures 2. Poles 3 and 4 and posts 10A–10C have all been machined in one single process to assure that they will all lie in the same plane 11 so that when cap 8 is attached to plate 1 by means of screws 39 through apertures 8A–8C and hollow post 10A–10C, the armature backstop area 35 of cap 8 will lie parallel to the plane of poles 3 and 4 so that the air gaps 61 between poles 3 and armatures 6 when armature tips 7 rest on area 35 will be substantially uniform for all poles 3 and armatures 6 in the print head as well as for all print heads manufactured of the same design. A compressor spring 37 is provided to bias armature 6 in place above pole 4.

Figure 4:
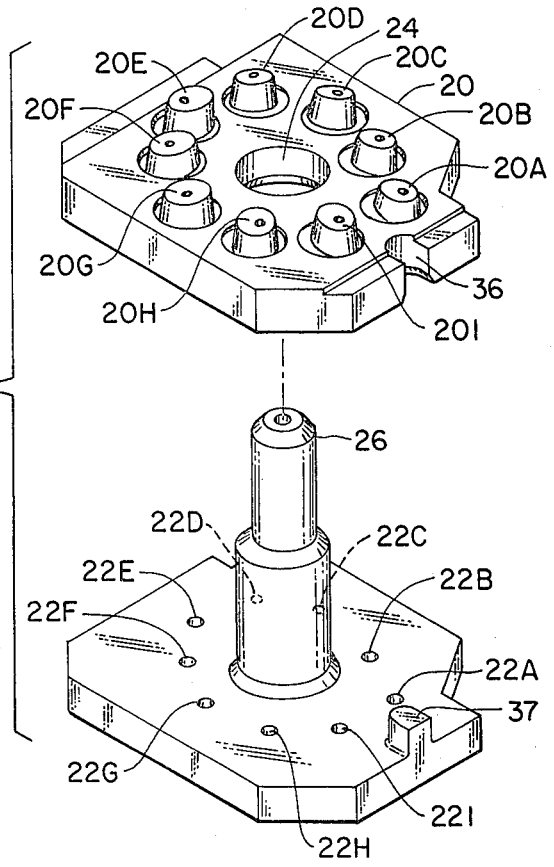
FIG. 4 is a perspective view of the two-piece styli support plate.

FIG. 4 illustrates a top support plate 20 and a bottom support plate 22 where plate 20 has a series of cone-shaped apertures 20A–20I through plate 20 positioned about its periphery with a center aperture 24. Plate 22 has a series of straight apertures 22A–22I through its surface configured about its periphery in the same manner as are apertures 20A–20I on plate 20. Plate 22 further has an elongated alignment post 26 extended vertically from its centermost portion. Apertures 20A –20I and apertures 22A–22I are configured about the surfaces of plates 20 and 22 in an irregular oval-like like configuration (see FIG. 5 description). A plurality of stylus print wires (see FIG. 6 description) are extended through the combined apertures 20A–20I and 22A–22I of plates 20 and 22 when the two plates 20 and 22 are connected to each other and as such the wires will form a configuration like that of the apertures about the peripheries of the two plates. When plates 20 and 22 are connected to each other alignment post 26 extends through aperture 24 of plate 20 to both connect plates 20 and 22 and to align the apertures of plate 20 with those of plate 22. The apertures of the two plates 20 and 22 are further aligned by slot 36 of plate 20 which is designed to receive tab 37 of plate 22. Plates 20 and 22 may be connected and their apertures aligned with each other by means other than post 26 and aperture 24 and slot 36 and tab 37, but these means are desirable for reasons to be explained hereafter.

Figure 5:
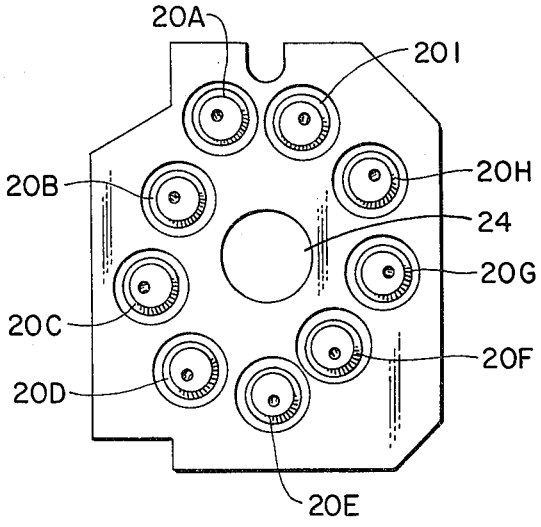
FIG. 5 is a top plan view of the top plate of the two piece styli support plate.

FIG. 5 is a top view of plate 20 illustrating the oval-like configuration of the apertures of plate 20.

Figure 6:
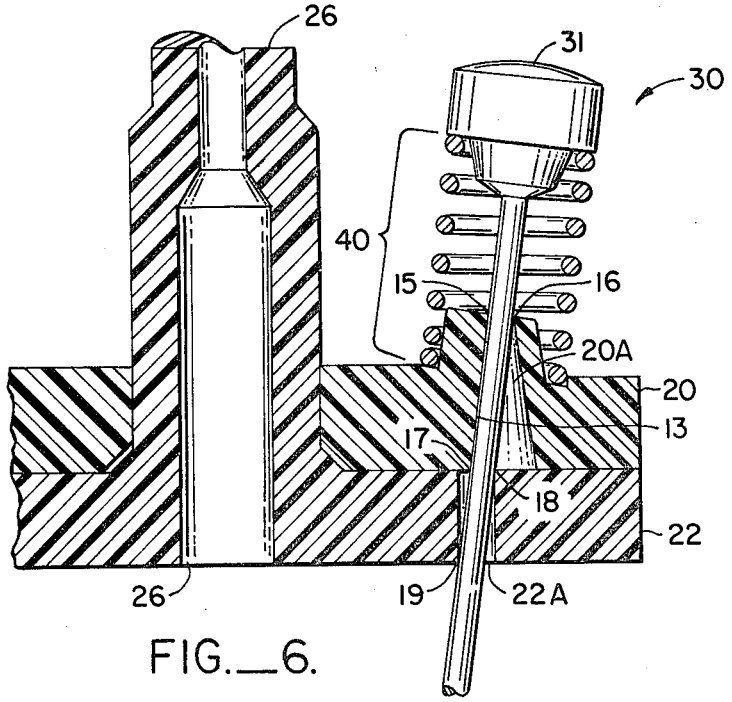
FIG. 6 is a cut-away view of the two piece styli support plate illustrating a stylus while it is extended through the plate's apertures; and, FIG. 7 illustrates the inner surface of a cap plate constructed in accordance with the invention.

FIG. 6 illustrates a cut-away view of plates 20 and 22 affixed to each other with a stylus print wire 30 having head 31 extending through cone-shaped aperture 20A of plate 20 and straight apertures 22A of plate 22. Stylus wire 30 is passed through apertures 20A and 22A at an angle relative to the two plates. Stylus wire 30 is shown with a compression spring 40 located near the input end of wire 30, which biases stylus 30 back into its restful position after stylus 30 has been propelled at its head 31 by armature tip 7 of FIG. 3 to print a dot on recording medium 55. Stylus wire 30 is shown supported by apertures 20A and 22A at points 15–19 of the combined aperture formed by 20A and 22A and by portion 13 of cone-shaped aperture 20A. When cone-shaped aperture 20A is connected to straight aperture 22A in the manner described, it will support stylus 30 in much the same way as would be the case were apertures 20A and 22A a single slanted aperture.

Figure 7:
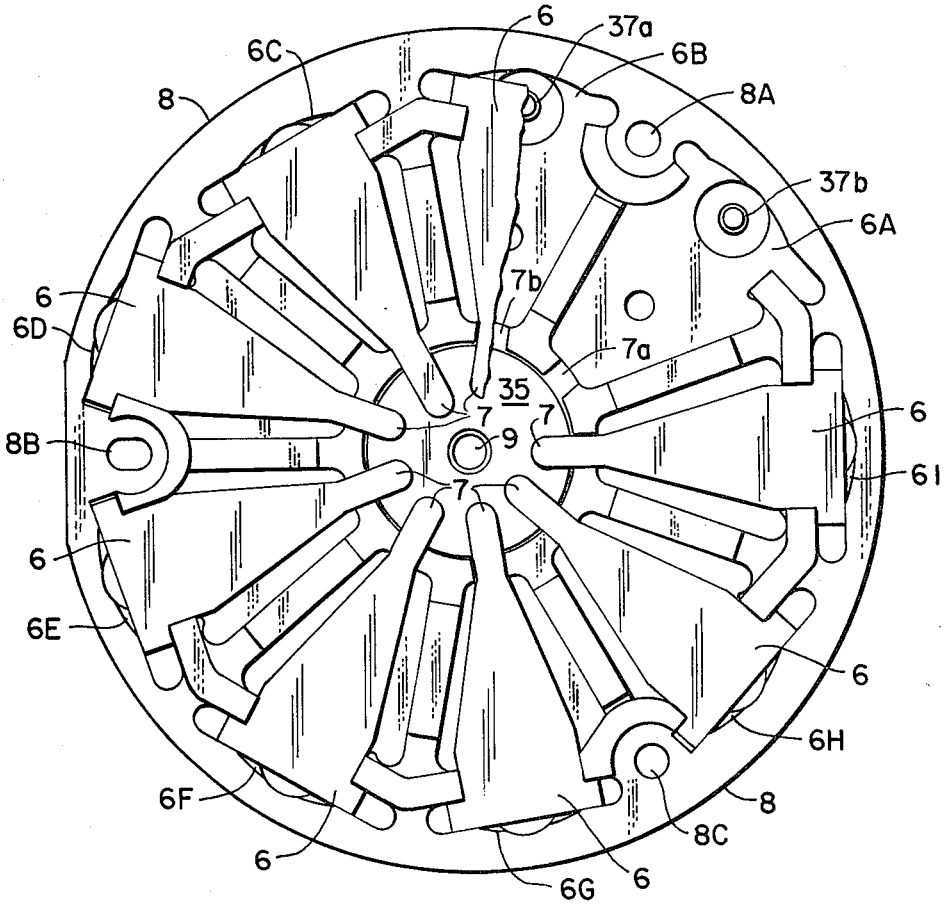

FIG. 7 illustrates a cap plate 8 with an armature backstop area 35 which has a rubber disc affixed about its surface to minimize the noise level when area 35 is contacted by armature tips 7. Plate 8 further has areas 6A–6I conforming to the general size and shape of armatures 6 to receive armature 6 with a portion of areas 6A–6I, represented by numerals 7A–7I to receive armature tips 7 when tips 7 are in contact with area 35. Cap 8 is further illustrated with apertures 8A–8C about its outer periphery. Compression springs are located about areas 37A–37I of all areas 6A–6I to bias armatures 6 in place above poles 4 (see FIG. 3 description).

When in operation, Plates 20 and 22 in one embodiment of the invention are connected to each other by extending alignment posts 26 through aperture 24 and the combined two-piece plate becomes a part of the stylus guide assembly 60 and 40 of FIGS. 1 and 3, respectively. Plates 20 and 22 may, however, be connected to each other by means other than posts 26 and aperture 24, but post 26 being extended through aperture 24 has the further effect to aligning the apertures of plate 20 with those of plate 22. The apertures of the two plates are further aligned by slot 36 receiving tab 37 when the two plates are connected to each other. A series of styli or print wires are extended through the apertures of plates 20 and 22 as is illustrated by styli 50A–50I in FIGS. 1 and 3.

Upon energization of the electromagnetic structure 2, pole 3 with coil 5 wrapped around it forms a magnetic pole which attracts armature 6 towards it. Tips 7 of armature 6 is in contact with a stylus head 43, as shown in FIG. 3, and is also in contact with armature backstop area 35 of cap 8, as illustrated in FIG. 3, prior to pole 3 being actuated to attract armature 6 towards it. When tip 7 is in contact with area 35, there exists an air gap 60 between pole 3 and armature 6. When magnetic pole 3 is actuated to attract armature 6, tip 7 propells stylus 50A through distance 61 so that armature 6 makes contact with pole 3. Once armature 6 contacts pole 3, it applies a force to stylus head 43 which is sufficient to cause stylus 50A to continue its flight through guide assembles 60 and 40 to impact a recording medium 55.

Once stylus 50A has impacted recording medium 55, it returns back through the stylus guide assembly to again contact armature tip 7 with a force which will cause armature 6 to break contact with pole 3 and revert to its rest position against armature backstop area 35. Backstop area 35 has been provided with a rubber disc to minimize the noise level upon the return of armature tip 7 to the backstop area.

When pole 3 is actuated to attract armature 6, where armature 6 must move toward pole 3 through the distance represented by air gap 61, air gap 61 must be of a width or dimension such that the force calculated to attract armature 6 will be sufficient to move armature 6 through the distance 61. That is, it is important for air gap 61 not to be so large that the force with which pole 3 attracts armature 6 will not be sufficient to move armature 6 through the distance to propell a stylus 50A. In efforts to assure that air gap 61 will be of a substantially uniform distance for all of the poles 3 and the stylus print heads so that poles 3 will attract armature 6 with a sufficient force for armature 6 to propell a stylus through a guide assembly to impact a recording medium, all poles 3 and 4 of the print head have been positioned in the same plane with three alignment posts 10A–10C distributed about base plate 1 between the electromagnetic structure 2 to define the plane of the electromagnetic structures and to receive screws 38 (see FIG. 3) which extend through certain apertures 8A–8C of cap plate 8 when cap 8 is connected to plate 1. Cap 8, when affixed to plate 1 where all of posts 10A–10C are in the same plane, will have its backstop area 35 also lying substantially parallel to the plane of poles 3 and 4. With the backstop area 35 lying parallel to the plane of poles 3 and 4 and when tips 7 are in contact with area 35 of cap plate 8, air gaps 62 between armatures 6 and poles 3 will be substantially uniform for all poles 3 of the print head unit, resulting in armatures 6 propelling a stylus 50A through a predetermined distance each time a pole is selectively actuated.

By locating all poles 3 and 4 in the same plane and by positioning a backstop area of the cap plate in a plane which is parallel to that of the poles 3 and 4, we have effectively eliminated the need to adjust the air gap areas 61 as was done in the prior art print heads, by controlling the distance through which the armature 6 must move to propell the stylus wire from its rest position to the position where the armature contacts the attracting poles and the stylus continues on its flight path where the stylus will eventually impact the recording medium. Poles 3 and 4 have all been positioned in this same plane on base plate 1 by machining or forming all poles 3 and 4 at the same time in the same process and by further machining alignment posts 10A–10C at the same time that poles 3 and 4 are machined to assure that they will all lie in substantially the same plane. This method of machining will assure that all electromagnetic structures for all print heads manufactured with the same design will likewise have substantially uniform air gaps between the attracting magnetic poles and the armatures which propell the stylus wires when the armatures are in their restful position.

The elongated post of support plate 22 which, in one embodiment of the invention, is extended through aperture 24 of plate 20 when plates 22 and 20 are connected to each other, has still another function in that it serves to properly align tips 7 or armatures 6 with its respective stylus head which it must propell. That is, when the guide assembly is attached to cap plate 8, as illustrated in FIG. 1, post 26 extends through aperture 9 of cap plate 8. Looking at FIGS. 2 and 7, it can be seen that posts 26 extending through apertures 9 have all nine armature tips 7 surrounding it in very close proximity, though not touching posts 26, to assure that each armature tip 7 is properly located above its respective stylus head. FIG. 7 illustrates how tips 7 are positioned, during their rest periods, into slot areas 7A–7I of cap plate 8 to cause tips 7 to rest against armature backstop area 35. Compression springs 37 (FIG. 3) are positioned about posts 37A–37I of cap plate 8 to bias the remaining portions of armatures 6 in place over poles 4 at all times.

When stylus wire such as 50A are extended through plates 20 and 22 when they form a part of a stylus guide assembly 60 or 40, such stylus wires are configured at their input end where they are in contact with armature tips 7 in an oval-like configuration and are configured at their impact or print end in a straight line configuration. Because of this variance in the wire configuration at their input and their impact or print ends, as has been explained in detail above, it is necessary for the print wires 50A–50I to be positioned in a slanted position at their input end through plates 20 and 22. To this end, plates 20 and 22 have been provided each with apertures of a different configuration which when they are connected together will give a stylus 30 (FIG. 6) the same support as a single long slanted aperture. However, such an aperture constructed in accordance with the invention is far more economical to manufacture than is a single long slanted aperture. FIG. 6 illustrates how a stylus wire 30 is supported by the combination of the cone-shaped aperture in plate 20 and straight aperture in plate 22. The stylus, as shown, is supported at points 15, 16, 17, 18 and 19 and also at area 13 of cone-shaped hole 20A in much the same manner as the stylus wire would be supported by a single slanted aperture through a single support bearing which would be of equal thickness as plates 20 and 22 combined. By combining plates 20 and 22, with each plate having apertures of a different configuration as has been explained, we have eliminated the necessity of forming seven or nine (depending upon the number of print wires used) apertures in a support bearing in seven or nine different directions for supporting the print wires in a slanted position through the support bearing.

We have found that during several print cycles, certain print wires are more frequently used to form characters than are other wires. Because of such, we have found a way to favor these most frequently used print wires by requiring that they bend the least at their input end so as to minimize the amount of wear on these wires during the print cycle where they are frequently used. This we have accomplished by configuring the input end of the print wires in an oval-like design. With such a design the wires which are most frequently used can be positioned at a point about the oval so that they are required to bend the least during the print cycle. Such an accomplishment is a great improvement over the elliptical configuration of the print wires in the U.S. Pat. No. 3,994,381, where all wires were required to bend the same amount. Such wires were bent equally shallow or equally deep, favoring none with less bend depending on their frequency of use. As earlier stated, in the U.S. Pat. No. 3,994,381, either all wires were favored or none were favored. The oval configuration of our invention is a great improvement over the '241 patent where the input ends of the print wires were configured in a circle. Some of the wires in the '241 patent were favored and some were not favored, but there was no relationship between those wires which were favored and the frequency of their use. With the circular configuration of the '241 patent, the wires which were favored were so favored simply because of their location in the circle and further because a circular configuration was desirable because of the ease in manufacturing the support bearing to support such a configuration. In the present oval configuration of our invention, some print wires are bent more than all of the print wires in the elliptical configuration of the U.S. Pat. No. 3,994,381, but none are required to bend as much at their input end as the wires in the circular configuration of the '241 patent which are required to bend the most. That is, some of the print wires in our oval configuration may be worse off (with more bend) than some of the wires in the U.S. Pat. No. 3,994,381 elliptical configuration, but none of the wires, including those which are bent the most, in our oval-like configuration are bent as much as the wires in the circular configuration with the greatest bend at their input end. It follows that the print wires configured in an oval-like configuration as taught by our invention will, overall, have a greater lifespan and have greater performance than will the print wires in the '241 patent and will have a better overall performance than the print wires in the U.S. Pat. No. 3,994,381.

The invention has been described in detail with particular reference to certain embodiments thereof, but it will be understood that variations and modifications can be effected within the spirit and the scope of the invention.

What is claimed is:

1. A wire matrix impact print head commprising:

a mounting base plate;

a cap plate having a central aperture;

stylus guide means, including a first guide means having at least a first and a second support plate, with each support plate having a plurality of apertures distributed about its outer periphery, with the vertical axis of each one of said plurality of apertures in each of said plates being parallel to the axis of each of the other apertures in said plate, means for connecting said support plates one to the other contiguously and means for aligning the apertures of each of said support plates with the apertures of said other support plates, said stylus guide means being connected to said base plate;

a plurality of electromagnetic structures distributed about the outer periphery of said base plate and disposed around the topmost portion of said guide means including said first guide means, relative to said base plate, with each of said electromagnetic structures having an outer pole, a center pole coupled to said outer pole, and a coil disposed around one of said poles;

a plurality of armatures disposed radially about said topmost portion of said guide means, each of said armatures being associated with one of said electromagnetic structures to form an electromechanical actuator for transferring electromechanical energy to a stylus, and each of said armatures having a stylus engaging end and an outer end; and, a plurality of styli carried by said guide means, each of said styli being of an elongated rod-like configuration having a free head end for engagement by the stylus engaging end of one of said armatures and a printing end for impacting a recording medium when the stylus is propelled through and said guide means by one of said actuators.

2. A wire matrix print head of the type set forth in claim 1 wherein said aligning means includes an aperture about the centermost portion of said first support plate and an elongated post positioned about the centermost portion of said second plate, said aperture and said post each being of a diameter such that said post will extend through said aperture when said second plate is affixed to said first plate.

3. A wire matrix impact print head according to claim 2 wherein said elongated post of said second support plate further extends through said central aperture of said cap plate after said post extends through said center aperture of said first support plate to connect said stylus guide means to said cap plate.

4. A wire matrix print head according to claim 1 wherein said alignment means further comprises at least one slot located about the outer periphery of said first plate and at least one tab located about the outer periphery of said second plate to correspond to the location of said slot on said first plate with said slot receiving said tab when said first plate is connected to said second plate.

5. A wire matrix print head of the type set forth in claim 1 wherein the apertures of said first plate and said second plate are each of a configuration such that when said styli passes through said first plate and said second plate affixed to said first plate, said styli will be supported by said plates at an angle relative to said plates, in much the same manner as said styli would be supported by a single slanted aperture.

6. A wire matrix print head according to claim 5 wherein the apertures of said first support plate are cone-shaped and the apertures of said second plate are straight such that said styli will be supported by said first and second support plates at an angle relative to said first and second plates in much the same manner as said styli would be supported by a single slanted aperture.

7. A wire matrix impact print head according to claim 1 wherein said plurality of electromagnetic structures distributed about the periphery of said base plate each has its center pole and its outer pole located in substantially the same plane as the center and outer poles of the other electromagnetic structure, said base plate further has three alignment posts located in the same plane as the center and outer poles of said electromagnetic structures and distributed at equi-distance about the periphery of said plate between said electromagnetic structures and wherein said cap plate further comprises about the central portion of its inner surface an armature backstop area for contact by the stylus engaging end of said armatures after said stylus has been propelled by said actuators, areas conforming generally to the size and shape of said armatures to receive said armatures in a restful position, three planar apertures distributed at equi-distance about the periphery of said cap plate and corresponding in location to said three alignment posts of said base plate such that when said base plate is connected to said cap plate by screws extending through said planar apertures, said screws will further extend through said alignment posts and said backstop area of said cap plate will lie substantially parallel to the plane of said center and outer poles such that the air gaps between said armatures and said center poles of each of said electromagnetic actuators are substantially uniform.

8. A wire matrix impact print head according to claim 1 wherein all components of said print head are completely enclosed within a housing structure.

9. A wire matrix impact print head comprising:

a mounting base plate having a substantially rectangular central aperture;

a top cap plate having a substantially circular central aperture;

stylus guide means, including a substantially rectangular first guide means having at least first and second support plates with each support plate having a plurality of guide apertures distributed about its outer periphery in a substantially oval array, with the vertical axes of each one of said plurality of apertures in each of said plates being parallel to the axis of each of the other apertures in said plate, means for connecting said first support plate to said second support plate contiguously and means for aligning the apertures of said first support plate with the apertures of said second support plate, the bottom of said guide means having a plurality of apertures arranged in a continuous linear array and said stylus guide means being connected to said base plate by extending said first guide means through said rectangular aperture of said base plate;

a plurality of springs;

a plurality of styli, each having an enlarged head at one free end and passing through one of said springs, through one of said guide apertures of said first and second support plates connected to each other and through one of said guide apertures in the bottom end of said guide means, said spring serving to resiliently bias said styli into a rest position;

a plurality of electromagnetic structures distributed about the periphery of said mounting base plate, each of said structures having an outer pole and a center pole each of said structures having an outer pole and a center pole coupled to said outer pole and a coil wrapped around one of said poles, and a plurality of elongated armatures, each having a sytlus engaging end and an outer end and each being associated with one of said electromagnetic structures and pivotable about the outer pole thereof, the respective combinations of armature and electromagnetic structure forming a plurality of electromagnetic actuators for selectively propelling various ones of said styli through said guide apertures.

10. A wire matrix impact print head of the type set forth in claim 9 wherein the apertures of said first plate and said second plate are each of a configuration such that when said styli passes through said first plate connected to said second plate said styli will be supported by said plates at an angle relative to said plates in much the same manner as said styli is supported by a single slanted aperture.

11. A wire matrix impact print head of the type set forth in claim 10 wherein the apertures of said first support plate are cone-shaped and the apertures of said second plate are straight such that when said styli passes through said first support plate connected to said second support plate said styli will be supported by said plates at an angle relative to said plates in much the same manner as said styli is supported by a single slanted aperture.

12. A wire matrix impact print head according to claim 9 wherein said plurality of electromagnetic structures distributed about the periphery of said base plate each has its center pole and its outer pole located in substantially the same plane and the center and outer poles of the other electromagnetic structure, said base plate further has three alignment posts located in the same plane as the center and outer poles of said electromagnetic structures and distributed at equi-distance about the periphery of said plate between said electromagnetic structure and wherein said cap plate further comprises about its innermost surface an armature backstop area for contact by the stylus engaging end of said armatures after said stylus has been propelled by said actuators, areas conforming generally to the size and shape of said armatures to receive said armatures, three planar apertures distributed at equi-distance about the periphery of said cap plate and corresponding in location to said three alignment posts of said base plate such that when said base plate is connected to said cap plate by screws extending through said planar apertures said screws will further extend through said alignment posts, said backstop area of said cap plate will lie substantially parallel to the plane of said center and outer poles such that the air gaps between said armatures and said center poles of each of said electromagnetic actuators are substantially uniform.

13. A wire matrix print head of the type set forth in claim 9 wherein said aligning means includes an aperture about the centermost portion of said first support plate and an elongated post positioned about the centermost portion of said second plate, said aperture and said post each being of a diameter such that said post will extend through said aperture when said second plate is affixed to said first plate.

14. A wire matrix impact print head according to claim 13 wherein said elongated post of said second support plate extends through said central aperture of said cap plate after said post extends through said first support plate to connect said stylus guide means to said cap plate.

15. A wire matrix print head according to claim 9 wherein said alignment means further comprises at least one slot located about the outer periphery of said first plate and at least one tab located about the outer periphery of said second plate to correspond to the location of said slot on said first plate with said slot receiving said tab when said first plate is connected to said second plate.

16. A wire matrix impact print head of the type described in claim 9 wherein all elements of said print head are substantially enclosed within a housing structure.

17. A wire matrix impact print head comprising:

a mounting base plate;

a cap plate having a central aperture, there planar apertures distributed at equi-distance about the periphery of said cap, an armature backstop area located about the central portion of the inner surface of said cap plate for contact by the stylus engaging end of said armatures when the stylus has been propelled by the armature, and areas conforming generally to the size and shape of the armatures to receive the armatures in their restfull position;

stylus guide means, including a first guide means having at least a first and second support plate with said first plate having an aperture about its centermost portion and said second plate having an elongated post about its centermost portion and with each support plate having a plurality of apertures with the vertical axes of each of said apertures in each said plate being parallel to the axes of each of the other apertures in said plate, and with said apertures distributed about the outer periphery of each plate in a configuration such that when said first support plate is connected to said second support plate with said elongated post of said second support plate extending through said central aperture of said first support plate to align the apertures of said first support plate with the apertures of said second support plate, a stylus extended through said aperture at an angle relative to said plates in much the same manner as the stylus would be supported by a single slanted aperture through said plates, said stylus guide means is connected first to said base plate and then to said cap plate with said elongated post of said second support plate extending through the central aperture of said cap plate;

a plurality of electromagnetic structures, each having a center and an outer pole with a coil wrapped around the center pole, distributed about the outer periphery of said base plate with three hollow alignment posts distributed at equi-distance about the periphery of said base plate and between said electromagnetic structures, with locations corresponding to the locations of said planar apertures in said cap plate, said center and outer poles of each of said electromagnetic structures and said alignment posts are all located in substantially the same plane such that when said base plate is connected to said cap plate by screws extending through said planar apertures and said hollow alignment posts, said backstop area of said cap plate will lie substantially parallel to the plane of said center and said outer poles such that the air gaps between the armatures and said center poles of each of said electromagnetic structures are substantially uniform;

a plurality of armatures disposed radially about said topmost portion of said guide means, each of said armatures being associated with one of said electromagnetic structures to form an electromechanical actuator for transferring electromechanical energy to a stylus, and each of said armatures having a stylus engaging end and an outer end; and, a plurality of styli carried by said guide means, each of said styli being of an elongated rod-like configuration having a free head end for engagement by the stylus engaging end of one of said armatures and a printing end for impacting a recording medium when the stylus is propelled through the guide means by one of said actuators.

* * * * *

UNITED STATES PATENT AND TRADEMARK OFFICE

CERTIFICATE OF CORRECTION

PATENT NO. : 4,240,756

DATED : Dec. 23, 1980

INVENTOR(S) : Joseph P. Ku and Richard D. Trezise

It is certified that error appears in the above-identified patent and that said Letters Patent are hereby corrected as shown below:

Please insert on cover page of patent the following:

--Assignee: Universal Microprinters, Inc
Foster City, California--

Signed and Sealed this

*Seventh* Day of *April 1981*

[SEAL]

*Attest:*

RENE D. TEGTMEYER

*Attesting Officer* *Acting Commissioner of Patents and Trademarks*